US005284329A

United States Patent [19]

Hohman et al.

[11] Patent Number: 5,284,329

[45] Date of Patent: Feb. 8, 1994

[54] SYSTEM FOR THE PRODUCTION OF POWDERS FROM METALS

[75] Inventors: Michael Hohman, Hanau; Norbert Ludwig, Niedernberg, both of Fed. Rep. of Germany

[73] Assignee: Leybold Aktiengesellshaft, Hanau, Fed. Rep. of Germany

[21] Appl. No.: 704,323

[22] Filed: May 23, 1991

[30] Foreign Application Priority Data

Jan. 25, 1991 [DE] Fed. Rep. of Germany ..... 4102101

[51] Int. Cl.[5] ..... H05B 6/36

[52] U.S. Cl. ..... 266/202; 75/367

[58] Field of Search ..... 266/200, 202; 75/363, 75/367, 10.14

[56] References Cited

U.S. PATENT DOCUMENTS

| | | | |
|---|---|---|---|
| H128 | 9/1986 | Routt | 373/35 |
| 2,754,346 | 7/1956 | Williams | 13/5 |
| 3,829,538 | 8/1974 | Darmara et al. | 264/8 |
| 4,048,436 | 9/1977 | Hiratake et al. | 219/123 |
| 4,631,384 | 12/1986 | Cornu | 219/121 P |
| 4,639,567 | 1/1987 | Stenzel | 219/10.43 |
| 4,762,553 | 8/1988 | Savage et al. | 75/363 |
| 4,787,935 | 11/1988 | Eylon et al. | 75/367 |
| 4,869,469 | 9/1989 | Eylon et al. | 75/10.14 |
| 4,873,698 | 10/1989 | Boen | 373/156 |
| 4,881,722 | 11/1989 | Koizumi et al. | 75/367 |
| 4,973,818 | 11/1990 | Bittenbrünn et al. | 219/121.28 |
| 5,004,153 | 4/1991 | Sawyer | 75/10.14 |
| 5,077,090 | 12/1991 | Sawyer | 427/241 |

FOREIGN PATENT DOCUMENTS

| | | |
|---|---|---|
| 3034677 | 4/1982 | Fed. Rep. of Germany . |
| 3433458 | 3/1986 | Fed. Rep. of Germany . |
| 3528169 | 2/1987 | Fed. Rep. of Germany . |
| 3921127 | 1/1991 | Fed. Rep. of Germany . |
| 0443574 | 2/1968 | Switzerland . |

OTHER PUBLICATIONS

"Aus Der Praxis Der Induktionshartung" p. 279 Dec. 1949.

*Primary Examiner*—Scott Kastler
*Attorney, Agent, or Firm*—Felfe & Lynch

[57] ABSTRACT

The invention relates to a system for the production of powders from metals. This system has a melting chamber (2) and a powder container (3) separated herefrom. In the melting chamber a metal rod (15) is melted through the high-frequency field of a coil (10) with differently dimensioned windings. The melted metal (28) penetrates through an opening (6) into the powder container (3) wherein it is pulverized in the region of the opening (6) due to different pressures in the melting chamber (2) and powder container (3) as well as by means of a dispersion system (5).

12 Claims, 2 Drawing Sheets

SYSTEM FOR THE PRODUCTION OF POWDERS FROM METALS

The invention relates to a system for the production of powders from metals.

Metals in powder form are required for the most diverse purposes. For example formed parts are produced by sintering etc. of metal powders. The production of materials and workpieces of powder-form metal is applied wherever all other methods of melting, alloying or casting or the cutting or the noncutting forming can be used only with great technical difficulties and large expenditures. Three steps can essentially be differentiated in powder-metallurgical processing: production of the powder, treatment and classification as well as compacting to form preforms which are close to the final contours of the product.

The production of the powder is a function of the physical and chemical properties of the material. Brittle metals can be ground, ductile ones can be processed in other ways to form powders. As a rule meltable metals are processed to form powders by dispersing the melt in a gas or water jet, chemically for example through electrolytic deposition, through thermal decomposition of volatile metal compounds in the gaseous phase, through the reduction of metal oxides or metal salt solutions or other processes.

A method is already known for the floatation zone production of rapidly quenched powders of reactive and refractory metals in which a rod to be disintegrated is placed at a positive dc voltage potential and disposed opposite a ring electrode which is at a negative potential (DE-P 35 28 169). The lower end of this rod is melted through an intermediate-frequency coil wherein melted and positively charged metal drops are guided through the negative ring electrode and further overheated through a succeeding high-frequency coil which effects a lowering of the viscosity facilitating the dispersion. The dispersion proper takes place through succeeding annular nozzles. The disadvantage of this method resides therein that intermediate and high frequencies are required.

Furthermore, a method is known for the production of superconducting ceramics in which a prealloying of the metal components in question of the material system are melted in the desired concentration ratio and from the obtained melt is formed an intermediate product using a rapid solidification technique (DE 39 21 127 A1). Herein the melt is brought to a temperature at which it is chemically homogeneous. Subsequently the melt brought to this temperature is dispersed to powder by means of an inert gas and subsequently the powder is annealed in an oxygen atmosphere so that oxide powder is formed. The melt is herein produced in conventional ways in a melting furnace.

Lastly, a method and a device are known for melting off rod-form material by means of an induction coil wherein the axial extent of the induction or disk coil is several times smaller than its radial extent (DE 34 33 458 A1). This induction coil has herein an opening which is smaller than the diameter of the rod and the lower rod end is held with its front face at an essentially constant axial distance above the induction coil. The scope of this known method or this known device is that the melt in largely uniform portions is melted off from the lower rod end and is always guided to the same downward path. To this end, the lower rod end is always disposed above the induction coil and not in it. Hereby the melting process becomes relatively slow.

The invention is therefore based on the task of, on the one hand, accelerating the melting off process and, on the other hand, achieving a simple and effective dispersal of the melted metal.

The advantage achieved with the invention resides in particular therein that through the creation of a conical melt-off surface at the end of the metal rod the melt surface is overall enlarged so that a high melting rate obtains. Moreover, thereby that the melt-off site is located directly above the dispersion device in a separate chamber with given pressure while the dispersion takes place in another separate chamber at a different pressure, a simple and effective pulverization of the metal is achieved. The metal rods used for melting can comprise cast or pressed material.

BRIEF DESCRIPTION OF THE DRAWINGS

An embodiment example of the invention is represented in the drawing and is described in further detail in the following. Therein show:

In FIG. 1 is represented a system 1 according to the invention comprising an upper melting chamber 2 and a lower dispersion chamber 3. Melting and dispersion chambers 2, 3 are separated from one another by a partitioning wall 4 in which is disposed an annular nozzle 5. Underneath this annular nozzle 5, in which is provided an opening 6 connecting the melting and dispersion chamber 2, 3 with each other, is located a collecting container 7 for disintegrated or pulverized metal 8. This collecting container can be separated from the dispersion chamber through a valve combination 9. Above the annular nozzle 5 is disposed an induction coil 10 which is supplied with electrical energy via connecting lines 11, 12 from a high-frequency generator 13 located outside the melting chamber 2. The induction coil 10 has a conical shape into which is immersed the tip 14 of the rod-form material 15 to be melted. The rod-form material 15 is connected with a support rod 16 which, in turn, is connected via a coupling 17 with a rotary drive 18. This rotary drive 18 is coupled with a carriage 19 for the vertical advance which is connected with an advance device 20 fastened on the ceiling 21 of the melting chamber 2. In the side wall of the melting chamber 2 is provided a door 22 with an observation window 23. Moreover, the melting chamber 2 is equipped with an apportioning valve 24 to which is connected a gas line 25. In corresponding manner on the dispersion chamber 3 is also disposed an apportioning valve 26 which is connected with a gas line 27.

Figure 1:
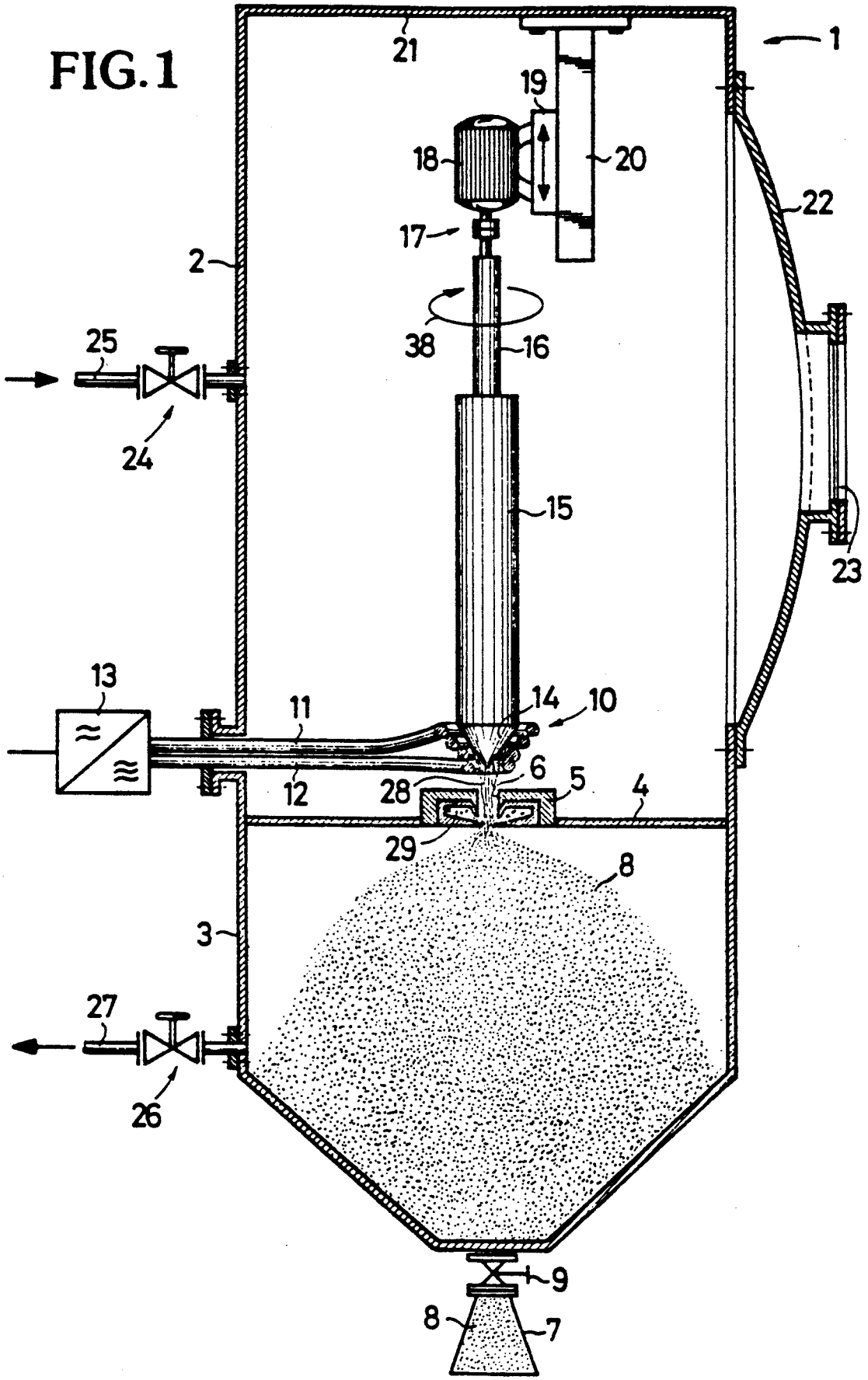
FIG. 1 an installation for the dispersion of melted metal.

Via the valve 24 gas is introduced into the melting chamber 2 while via the valve 26 gas is carried out of the dispersion chamber 3.

The process of melting and dispersing the rod-form material 15 takes place in the following manner:

First, with the material 15, which for example is titanium, still raised the induction coil 10 is supplied with electrical energy from the generator 13 whereupon it generates a strong high-frequency field into which the material 15 is lowered by the carriage 19 with a slight rotation according to arrow 38. Hereby the lower margin area of the material is melted off and through the electromagnetic pressure of the field of the coil 10 constricted to form a jet 28 which penetrates through the opening 6 into the dispersion chamber 3. For the motion of this jet 28, for one, gravity is responsible, and for another, the pressure differential between the melting chamber 2 and the dispersion chamber 3. The gradient of this pressure differential is directed from above in the downward direction. Due to the acceleration through the pressure gradient a dispersion effect of the jet 28 is already achieved which is still further increased through the annular nozzle 5 which blows a gas from its annular chamber 29 radially from the outside toward the inside onto the jet 28. Hereby the melted-off material is very finely dispersed so that for example for materials with a density of 4.5 g/cm$^3$ with throughputs of 20 kg/hr a $d_{50}$ of 50 $\mu$m is achieved. This fine powder is collected in the container 7 and later, when the container 7 is filled, separated from the dispersion chamber through a valve combination 9. The container can be removed without the dispersion unit with air for flooding. The lowering process of the material 15 as well as the melting process can be observed through the window 23.

Figure 2:
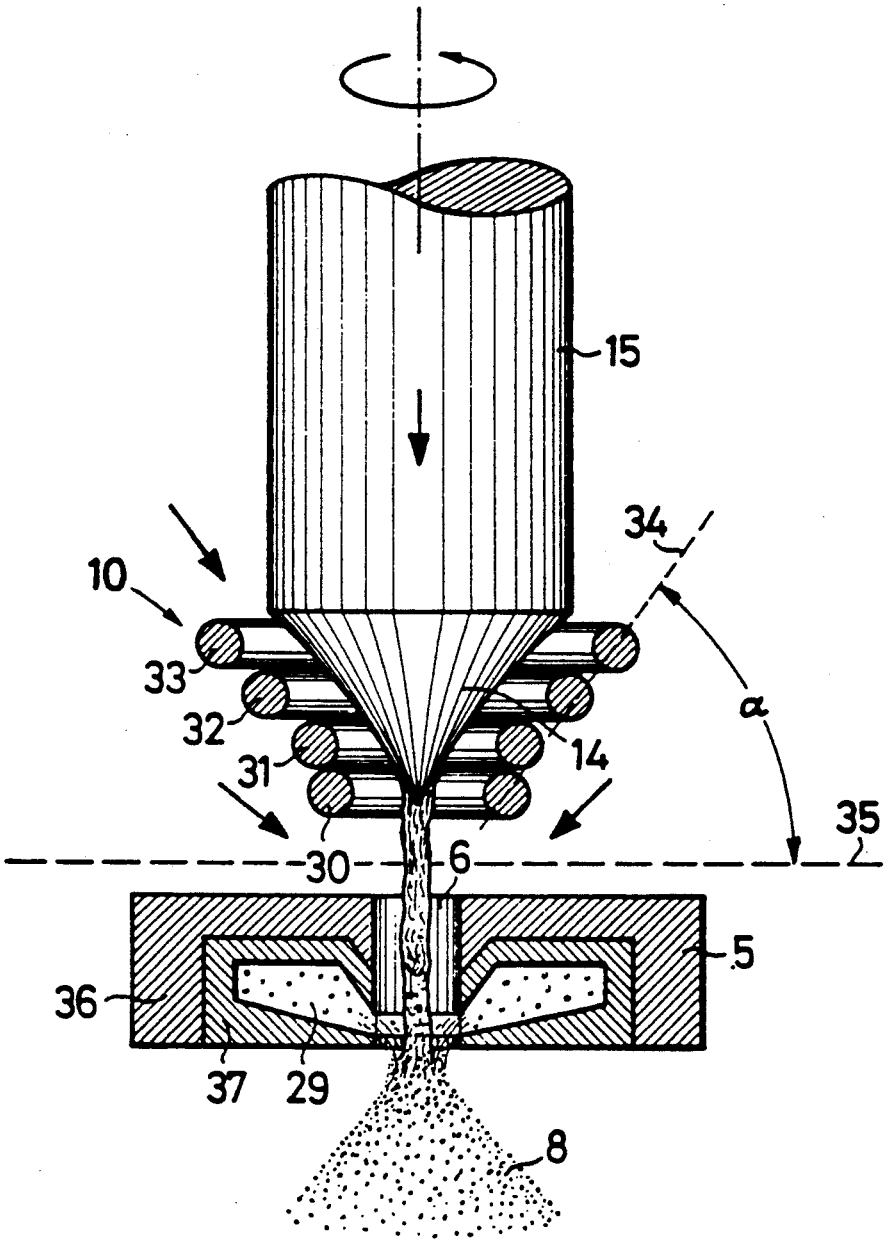
FIG. 2 an enlarged representation of the melt-off and dispersion area.

In FIG. 2 the area in which the material 15 is melted and dispersed is once again represented in an enlarged scale. It can herein be seen that the coil 10 comprises four windings 30, 31, 32, 33 disposed one above the other and forming a conical shape. This shape is defined in a first approximation through a slope 34 which with a horizontal straight line 35 forms an angle $\alpha$, which is preferably between 20 and 90 degrees. At the narrowest place of coil 10, consequently at winding 30, the diameter of the coil is preferably 20 mm.

The winding 31 in the representation of FIG. 2 is not exactly on the line 34 so that the coil assumes a somewhat hyperbolic shape which leads to especially favorable melt-off behaviour.

The gas nozzle 5 has an external housing 36 into which is fitted an annular channel 37 proper which assumes the function of a nozzle.

We claim:

1. System for the production of powders from materials which can be melted by an induction coil comprising: a rod; an induction coil for melting off material at a lower end of the rod, and which at least has two turns of a winding with different diameters of which a turn of the winding with a smaller diameter is further removed from an upper area of the rod than a turn of the winding with a greater diameter, a dispersion device dispersing the melted-off material, and a container collecting the disintegrated material, wherein:

a) a straight line (34) extending through the cross section center points of two adjacent coil turns have an angle of slope $\alpha$ between 20° and 90° and specifically relative to a horizontal line (35) extending perpendicularly to an axis of the rod (15);

b) a chamber (2) in which is disposed the rod (15) and a chamber (3) for receiving the disintegrated material (8) are separated from each other through a partitioning wall (4) having an annular nozzle (5) having an annular gap around an opening (6); and c) the system also comprising means for providing in the chamber (2) in which is disposed the rod (15) a higher gas pressure than in the chamber (3) in communication with which is disposed a container (7) for the disintegrated material (8).

2. System as stated in claim 1, in which the induction coil (10) has between two and eight turns of a winding (30 to 33) disposed on an imaginary conical surface.

3. System as stated in claim 1, in which a lowest winding diameter (30) of the induction coil is approximately 20 mm.

4. System as stated in claim 1, in which an uppermost winding diameter (33) is greater than the diameter of the rod (15).

5. System as stated in claim 1, which includes a driving device (19, 20) for the rod (15) which moves the rod (15) in the axial direction.

6. System as stated in claim 1, which includes a driving device (18) for the rod (15) whereby the rod (15) is rotated about its longitudinal axis.

7. System as stated in claim 1, in which the chamber (2) in which is disposed the metal rod (15) has a gas feed line (24, 25).

8. System as stated in claim 1, in which the chamber (3) in which is disposed the container (7) for the disintegrated material (8) has a gas drainage (26, 27).

9. System as stated in claim 1, in which the turns (30 to 33) of the winding of the induction coil (10) are disposed on a hyperbolic surface.

10. System as stated in claim 1, in which a point at which the melted-off material is dispersed is located maximally 100 mm away from the melt-off point.

11. System as stated in claim 1, which includes means for immersing the rod (15) with its lower end in the induction coil (10) at least to a depth of a plurality of coil turns.

12. System as stated in claim 11, in which a lowest point of a conically extending point (14) of the metal rod (15) is disposed in the area of the lowest turn (30) of the winding of the induction coil (10) while the end of the conicity, i.e. where the rod has its normal diameter, is located in the region of an uppermost turn (33) of the winding of the induction coil (10).

* * * * *